US012601476B2

(12) United States Patent
Kawashima et al.

(10) Patent No.: US 12,601,476 B2
(45) Date of Patent: Apr. 14, 2026

(54) RADIANT TUBE BURNER, RADIANT TUBE, AND METHOD OF DESIGNING RADIANT TUBE BURNER

(71) Applicant: JFE Steel Corporation, Tokyo (JP)

(72) Inventors: Tomoyuki Kawashima, Tokyo (JP); Akihiro Kobayashi, Tokyo (JP); Noriko Ozawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 766 days.

(21) Appl. No.: 17/797,269

(22) PCT Filed: Feb. 3, 2021

(86) PCT No.: PCT/JP2021/003975
§ 371 (c)(1),
(2) Date: Aug. 3, 2022

(87) PCT Pub. No.: WO2021/161875
PCT Pub. Date: Aug. 19, 2021

(65) Prior Publication Data

US 2023/0054425 A1 Feb. 23, 2023

(30) Foreign Application Priority Data

Feb. 10, 2020 (JP) ..... 2020-020549

(51) Int. Cl.

| | |
|---|---|
| ***F23D 14/22*** | (2006.01) |
| ***F23C 3/00*** | (2006.01) |
| ***F23C 9/08*** | (2006.01) |
| ***F23C 99/00*** | (2006.01) |
| ***F23D 14/12*** | (2006.01) |
| ***F23D 14/58*** | (2006.01) |
| ***F23L 1/00*** | (2006.01) |
| ***F23L 1/02*** | (2006.01) |
| ***F23L 3/00*** | (2006.01) |
| ***F23L 9/06*** | (2006.01) |
| *F23L 15/04* | (2006.01) |

(52) U.S. Cl.
CPC ..... *F23D 14/22* (2013.01); *F23C 3/002* (2013.01); *F23D 14/12* (2013.01); *F23L 1/02* (2013.01);
(Continued)

(58) Field of Classification Search
CPC ..... F23C 3/002; F23D 14/12; F23D 14/22; F23D 14/58; F23D 2900/14003;
(Continued)

(56) References Cited

U.S. PATENT DOCUMENTS 3,174,474 A * 3/1965 Jones ..... C21D 1/74 126/91 A
3,220,401 A * 11/1965 Jones ..... F23C 3/002 126/91 A
(Continued)

FOREIGN PATENT DOCUMENTS

CN 202132950 U 2/2012
CN 202660558 U 1/2013
(Continued)

OTHER PUBLICATIONS

An English translation of the International Preliminary Report on Patentability and Written Opinion dated Aug. 25, 2022, of counterpart PCT International Application No. PCT/JP2021/003975.
(Continued)

*Primary Examiner* — Michael G Hoang
*Assistant Examiner* — Logan P Jones
(74) *Attorney, Agent, or Firm* — DLA Piper LLP (US)

(57) ABSTRACT

A radiant tube burner, wherein an opening cross section of the tube is virtually divided into four areas with two straight lines as boundaries, the two straight lines being obtained by tilting a minor axis of the oval, which is a shape of the opening cross section, by ±45° with a center of the oval as a center, and a flow rate of primary combustion air injected from primary combustion air nozzles located in the areas containing the minor axis of the oval of the virtually divided four areas is lower than a flow rate of the primary combus-
(Continued)

tion air injected from the primary combustion air nozzles located in the areas not containing the minor axis of the oval the four areas.

9 Claims, 5 Drawing Sheets

(52) U.S. Cl.
CPC ..... *F23L 3/00* (2013.01); *F23L 9/06* (2013.01); *F23D 2900/14003* (2013.01); *F23D 2900/14064* (2013.01)

(58) Field of Classification Search
CPC ... F23D 2900/14064; F23L 1/02; F23L 15/04; F23L 3/00; F23L 9/06; Y02E 20/34
See application file for complete search history.

(56) References Cited

U.S. PATENT DOCUMENTS

| | | | | | |
|---|---|---|---|---|---|
| 3,225,757 | A | * | 12/1965 | Keller | F23C 3/002 126/90 A |
| 2007/0054227 | A1 | * | 3/2007 | Tada | F23D 14/22 431/181 |
| 2013/0291770 | A1 | | 11/2013 | Kashima et al. | |
| 2015/0241058 | A1 | | 8/2015 | Mine et al. | |

FOREIGN PATENT DOCUMENTS

| | | | | | |
|---|---|---|---|---|---|
| FR | 2485692 | A | * | 12/1981 | F23C 6/045 |
| JP | S63-113206 | A | | 5/1988 | |
| JP | S6446516 | A | * | 2/1989 | |
| JP | H02-85207 | U | | 7/1990 | |
| JP | H04-126905 | A | | 4/1992 | |
| JP | 2000356310 | A | * | 12/2000 | |
| JP | 2016161221 | A | * | 9/2016 | |
| JP | 2017-219235 | A | | 12/2017 | |
| KR | 100347573 | B1 | * | 8/2002 | |
| WO | 2012/098848 | A1 | | 7/2012 | |
| WO | 2014/027610 | A1 | | 2/2014 | |
| WO | 2017/212744 | A1 | | 12/2017 | |
| WO | 2018/034286 | A1 | | 2/2018 | |

OTHER PUBLICATIONS

Extended European Search Report dated Jul. 14, 2023, of counterpart European Patent Application No. 21753499.9.
International Search Report dated Mar. 9, 2021 in counterpart International Application No. PCT/JP2021/003975.
Written Opinion dated Mar. 9, 2021 in counterpart International Application No. PCT/JP2021/003975.
Concise Statement of Relevance of Office Action dated May 31, 2022 in counterpart Japanese Application No. 2021-521079.

* cited by examiner

RADIANT TUBE BURNER, RADIANT TUBE, AND METHOD OF DESIGNING RADIANT TUBE BURNER

TECHNICAL FIELD

This disclosure relates to a radiant tube.

BACKGROUND

A radiant tube is a device that supplies fuel gas and combustion air into a tube from a gas injection unit of a radiant tube burner for combustion, and indirectly heating an object to be heated present outside the tube by heat generated by the tube heated by the generated combustion gas. Therefore, in the radiant tube, the heat cannot be effectively used by the radiant tube alone due to a limited combustion space, and thus heat recovery is performed in the form of preheating of the combustion air using various exhaust heat recovery devices such as a recuperator and a heat storage burner, in many instances.

In the radiant tube, the combustion gas generated in the tube passes through the inside of the tube to be discharged. However, the radiant tube has a problem that, when the temperature of the combustion gas rises, the generation amount of harmful nitrogen oxides (NOx) increases. Therefore, the exhaust heat recovery amount is sometimes limited to reduce the NOx emission amount.

Conventionally, as a technology of reducing the generation of NOx in the radiant tube, the technologies described in JP S63-113206 A and JP 2017-219235 A are mentioned, for example.

JP '206 discloses a technology of reducing the generation of NOx by reducing the combustion rate by mixing exhaust gas with fuel gas or secondary combustion air using a fan. Further, JP '235 discloses purifying the generated NOx by a catalyst.

However, JP '206 requires the fan to guide the exhaust gas to the fuel gas or the secondary combustion air. For example, the installation of the fan for each radiant tube adversely affects maintainability. Further, the configuration of JP '206 also has a problem that the radiant tube increases in size due to the provision of the fan.

JP '235 has a problem of the deterioration of the catalyst due to poisoning, which is remarkable in the steel industry using by-product gas. Further, the configuration of JP '235 also has a problem that the radiant tube increases in size due to the provision of the catalyst.

It could therefore be helpful to provide a radiant tube burner and a radiant tube capable of reducing the generation of NOx with a simple configuration without adversely affecting maintainability and causing a reduction in a low NOx effect due to poisoning or the like.

SUMMARY

We conducted various combustion analyses including the generation of NOx around a burner, irrespective of the shapes of existing radiant tubes. We thus found that the opening cross-sectional shape of the radiant tube is set to be an oval shape having a long diameter and a short diameter different from each other, a secondary combustion air nozzle is arranged in the center of the radiant tube, a plurality of fuel gas nozzles and a plurality of primary combustion air nozzles are arranged along the circumferential direction around the secondary combustion air nozzle, and then primary combustion is performed at an air ratio of 1.0 or less so that a circulation flow is generated in a primary combustion area around the burner and the NOx concentration on the front side of the burner decreases. We further found that the NOx concentration further decreases by appropriately dividing the flow rate of primary combustion air injected from the plurality of primary combustion air nozzles between the long diameter side and the short diameter side of the tube-like oval.

We thus provide a radiant tube burner which is inserted and installed in a tube having an oval-shaped opening cross section and which has a gas injection unit having a secondary combustion air nozzle injecting secondary combustion air arranged in a center portion and a plurality of primary combustion air nozzles injecting primary combustion air and a plurality of fuel gas nozzles injecting fuel gas arranged to surround the secondary combustion air nozzle, in which the opening cross section of the tube is virtually divided into four areas with two straight lines as the boundaries, the two straight lines being obtained by tilting the minor axis of the oval, which is the shape of the opening cross section, by ±45° with the center of the oval as the center, and the flow rate of the primary combustion air injected from the primary combustion air nozzles located in the areas containing the minor axis of the oval of the virtually divided four areas is lower than the flow rate of the primary combustion air injected from the primary combustion air nozzles located in the areas not containing the minor axis of the oval of the four areas.

We also provide a method of designing a radiant tube burner adapted to be inserted and installed in a tube having an oval-shaped opening cross section and which has a gas injection unit having a secondary combustion air nozzle injecting secondary combustion air arranged in a center portion and a plurality of primary combustion air nozzles injecting primary combustion air and a plurality of fuel gas nozzles injecting fuel gas arranged to surround the secondary combustion air nozzle, the method including virtually dividing the opening cross section of the tube into four areas with two straight lines as boundaries, the two straight lines being obtained by tilting a minor axis of the oval, which is a shape of the opening cross section, by ±45° with a center of the oval as a center; and when a short diameter of the oval is defined as La and a long diameter orthogonal to the short combustion diameter is defined as Lb, setting an amount of the primary combustion air blown out from each of the primary combustion air nozzles such that a flow rate ratio (mt/mx) satisfies Equation (1), the flow rate ratio (mt/mx) being a ratio of a flow rate mt of the primary combustion air injected from the primary combustion air nozzles located in the areas containing the minor axis to a total air quantify mx of the primary combustion air injected from all of the primary combustion air nozzles, $La^2/(La^2+Lb^2) \leq (mt/mx) < 0.5$ (1).

We provide a radiant tube burner and a radiant tube capable of reducing the generation of NOx with a simple configuration.

REFERENCE SIGNS LIST

Figure 1:
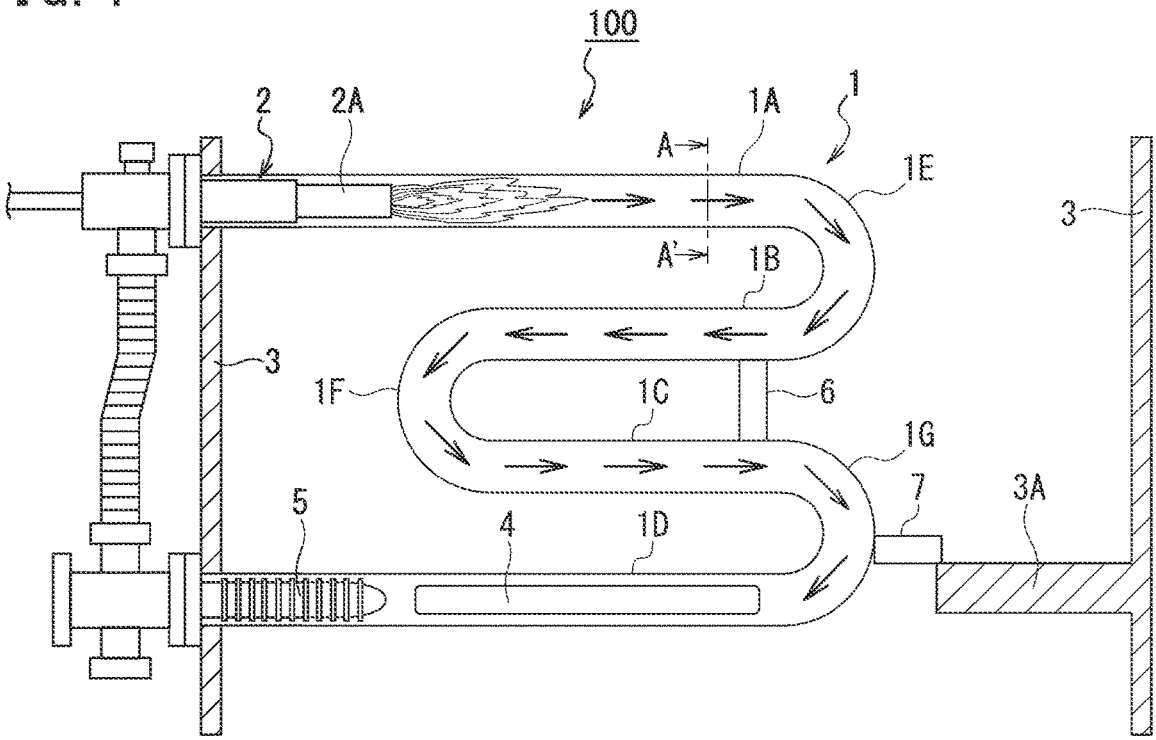
FIG. 1 is a schematic diagram showing a configuration of a radiant tube including a radiant tube burner according to an example.

1 tube
1A straight tube portion at most upstream position
2 radiant tube burner
2A gas injection unit
3 furnace wall
21 secondary combustion air nozzle
22 primary combustion air nozzle
22A, 22B primary combustion air nozzle on minor axis side
22C, 22D primary combustion air nozzle on major axis side
23 fuel gas nozzle
ARA-1 to ARA-4 area
La short diameter
Lb long diameter
X minor axis
Y major axis

DETAILED DESCRIPTION

Examples will now be described with reference to the drawings.

The drawings are schematic, and ratios or the like of the size and the length of each part are different from the actual ratios or the like of the size and the length. The examples described below exemplify the configurations embodying our technical concepts. Our concepts do not specify materials, shapes, structures and the like of constituent parts to the materials, shapes, structures, and the like described below. The technical concepts can be variously altered within the technical scope specified by the appended Claims.

An oval does not include a perfect circle, and a short diameter of the oval refers to the shortest diameter and a long diameter refers to the diameter in the direction orthogonal to the short diameter. A minor axis is an axis extending in the short diameter direction. A major axis is an axis extending in the long diameter direction.

Configuration

As illustrated in FIG. 1, a radiant tube 100 of this example includes a tube 1 through which combustion gas flows and a radiant tube burner 2 generating the combustion gas in the tube 1. The radiant tube 100 may or may not include a heat transfer promoter 4, various exhaust heat recovery devices 5 such as a recuperator and a heat storage burner, and other known parts.

Tube 1

As illustrated in FIG. 1, the tube 1 of this example has a zigzag shape with a substantially W-shaped side view and has vertically arranged four straight tube portions 1A to 1D, and is configured by connecting end portions of the straight tube portions 1A to 1D adjacent to each other by curved tube portions 1E to 1G extending in an arc shape. The reference numeral 6 indicates a separator member preventing the space between the adjacent straight tube portions from narrowing. The reference numeral 7 indicates a support member supported by a protruding portion 3A and suppressing the downward displacement of the tube.

The tube 1 is supported by a furnace wall 3 by the fixation of the inlet side of the straight tube portion 1A at the most upstream position and the outlet side of the straight tube portion 1D at the most downstream position to the furnace wall 3.

Figure 2:
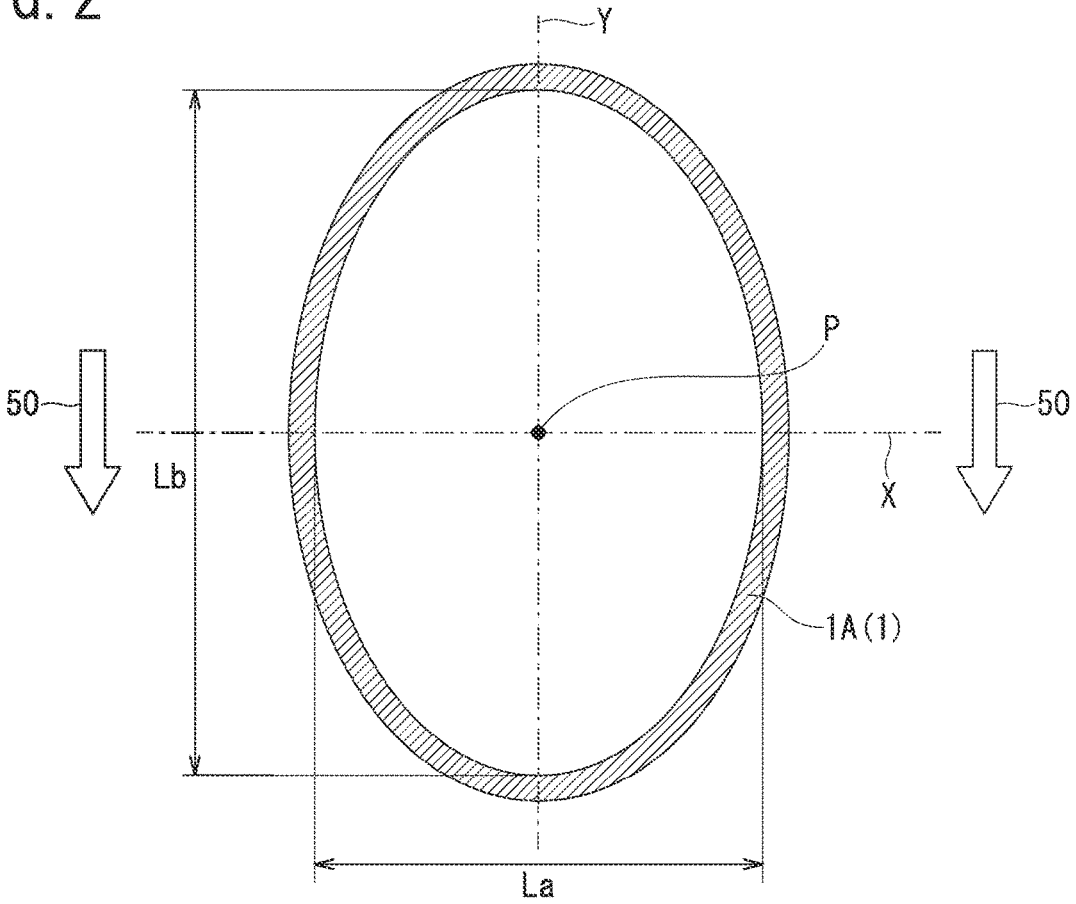
FIG. 2 is a view showing the opening cross-sectional shape of the tube illustrated in the A-A' cross section of FIG. 1.

The opening cross section of at least the straight tube portion 1A at the most upstream position of the tube 1 has an oval shape in which a short diameter La and a long diameter Lb are different from each other as illustrated in FIG. 2. More specifically, the opening cross section of the straight tube portion 1A at the most upstream position where a gas injection unit 2A of the radiant tube burner 2 is arranged has the oval shape in which the short diameter La and the long diameter Lb are different from each other. In this example, the oval shape has an oval shape in which a major axis Y is vertically directed over the entire length of the tube 1.

More specifically, the tube 1 is set such that the major axis Y which is the axis of the long diameter orthogonal to the short diameter of the oval above is directed in the vertical direction. By arranging the tube 1 such that the major axis Y of the oval is directed in the vertical direction, the rigidity of the tube 1 is improved as compared to when the opening cross-sectional shape of the tube 1 is a perfect circle shape, and the downward displacement of the straight tube portions 1A to 1D constituting the tube 1 due to the self-weight or a thermal load can be suppressed.

The oval defining the cross section of the tube is not particularly limited because, when the lengths of the short diameter La and the long diameter Lb are different from each other, the rigidity is improved as compared to the perfect circular shape. In the oval, (Long diameter Lb/Short diameter La) is set to be 1.1 or more and 1.4 or less, for example.

This example has a configuration in which an object to be heated (not illustrated) vertically moves in the front and the rear of the tube 1 so that the object to be heated is heated by radiant heat from the radiant tube 100. In FIG. 2, the reference numeral 50 indicates an example of the moving direction of the object to be heated.

Radiant Tube Burner 2

In the radiant tube burner 2, the gas injection unit 2A is inserted coaxially with the straight tube portion 1A from an upstream side end portion of the straight tube portion 1A in the straight tube portion 1A at the most upstream position as illustrated in FIG. 1. The gas injection unit 2A is a header portion where nozzles injecting combustion air and fuel gas are formed.

Figure 3:
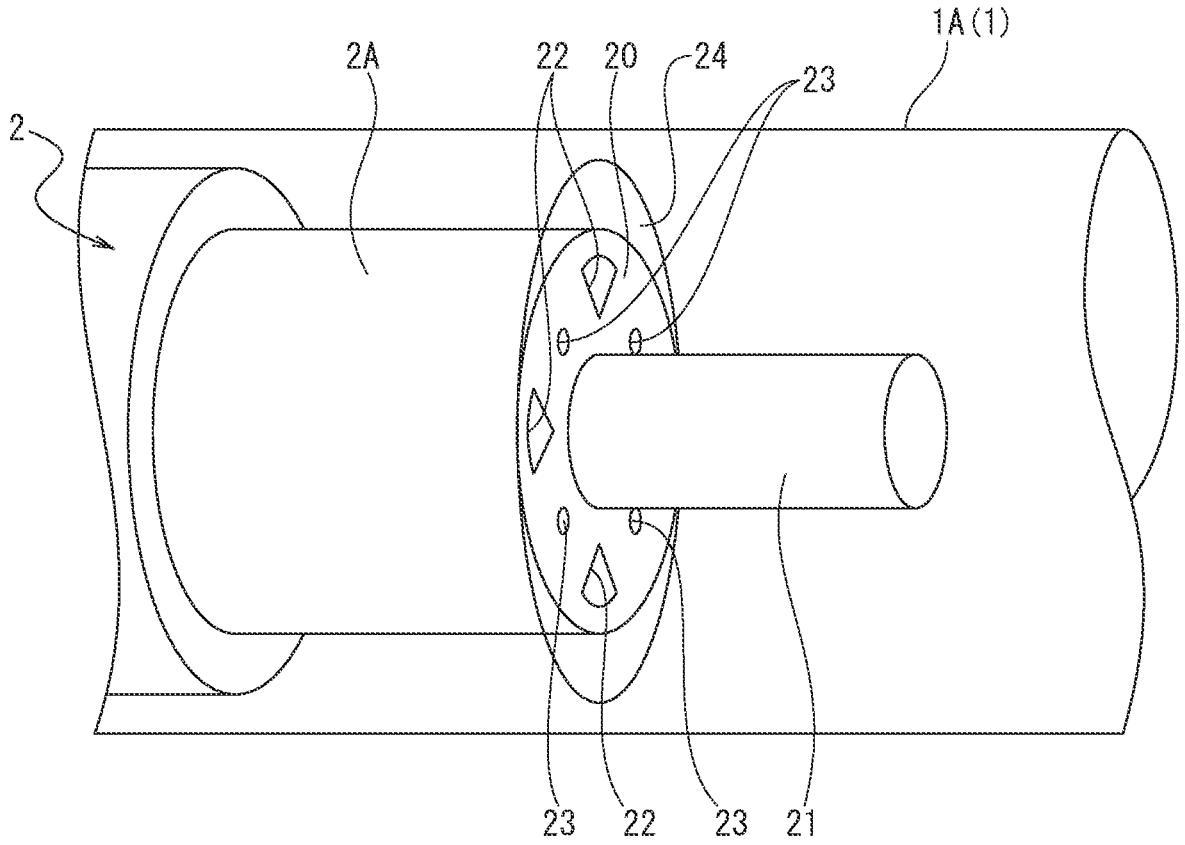
FIG. 3 is a schematic perspective view illustrating the relationship between a gas injection unit of the radiant tube burner and the tube.

As illustrated in FIG. 3, the gas injection unit 2A of this example has a columnar outer shape and is arranged such that a center p-axis of the columnar shape and a center p-axis of the tube 1 are coaxial with each other.

Figure 4:
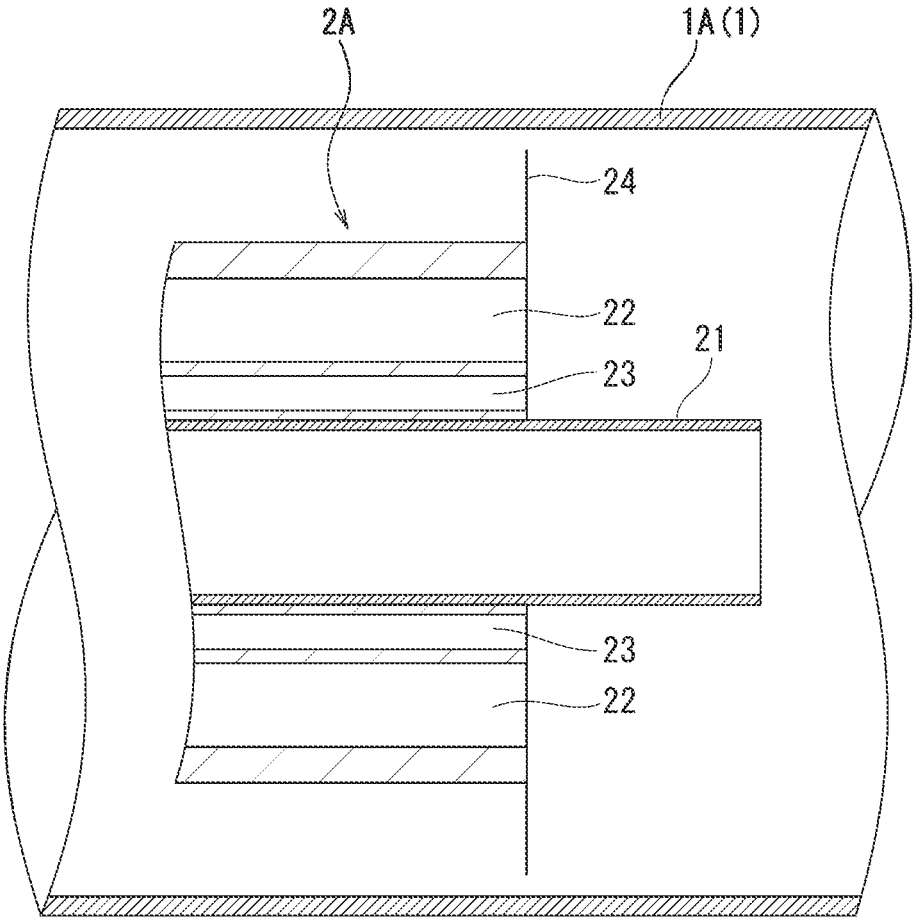
FIG. 4 is a conceptual diagram illustrating each nozzle of the gas injection unit.

In a tip portion of the gas injection unit 2A, a secondary combustion air nozzle 21, a plurality of primary combustion air nozzles 22, and a plurality of fuel gas nozzles 23 are provided. Hereinafter, the surface of the tip portion of the gas injection unit 2A is also referred to as a gas injection surface. As illustrated in FIG. 4, the gas injection axis of each nozzle is set parallel to the center p-axis of the gas injection unit 2A, and gas can be injected in the same direction as the extending direction of the tube 1.

The secondary combustion air nozzle 21 is a nozzle injecting secondary combustion air. The primary combustion air nozzle 22 is a nozzle injecting primary combustion air. The fuel gas nozzle 23 is a nozzle injecting fuel gas.

Figure 5:
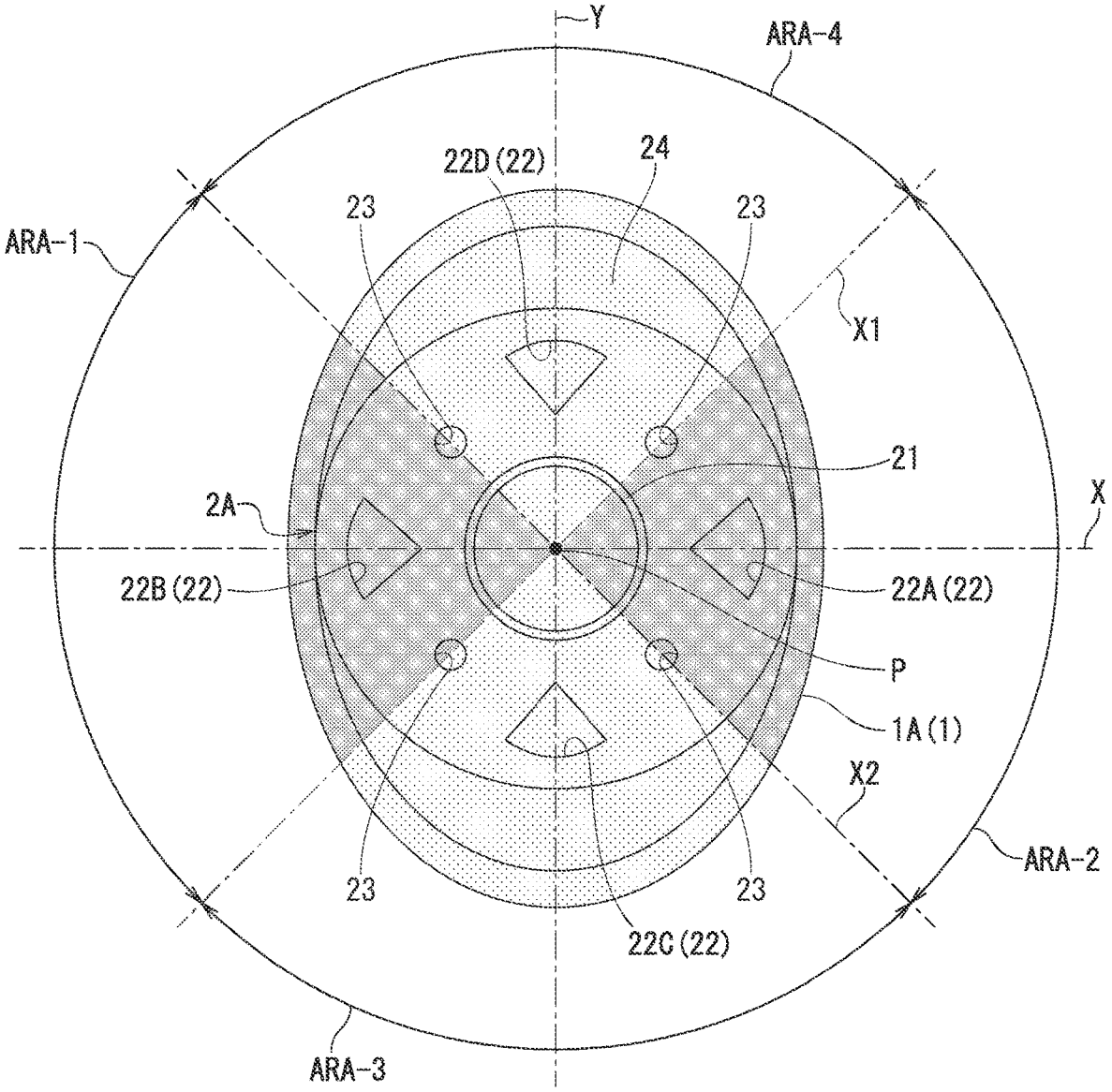
FIG. 5 is a front view illustrating the arrangement relationship between four areas and each nozzle.

As illustrated in FIGS. 3 to 5, the secondary combustion air nozzle 21 is arranged in a center portion of the gas injection surface of a circular shape and is constituted by a cylinder portion extending forward (gas injection direction) from the gas injection surface. The secondary combustion air nozzle 21 of this example is set to be coaxial with the gas injection unit 2A.

Further, on the gas injection surface, the plurality of primary combustion air nozzles 22 and the plurality of fuel gas nozzles 23 are arranged to surround the outer periphery of the secondary combustion air nozzle 21 at the outward position in the outer diameter direction of the secondary combustion air nozzle 21. In the gas injection surface, holes are opened for the formation of tip portion openings of the plurality of primary combustion air nozzles 22 and the plurality of fuel gas nozzles 23.

This structure is an example in which the plurality of primary combustion air nozzles 22 is provided to be point-symmetric with the center portion of the gas injection surface (center p of the oval) as the center; two primary combustion air nozzles 22 are provided on the left and right and two primary combustion air nozzles 22 are provided on the top and the bottom (four primary combustion air nozzles 22 in total). Each fuel gas nozzle 23 is arranged between the adjacent primary combustion air nozzles 22 along the circumferential direction.

Reference numeral 24 indicates a back plate, and the shape of the back plate 24 is an oval shape similar to the oval shape of the tube 1.

Primary Combustion Air

The flow rate of a total air quantity mx of the primary combustion air injected from all of the primary combustion air nozzles 22 is set such that the primary combustion is performed at an air ratio of 1.0 or less.

In this example, as illustrated in FIG. 5, the opening cross section of the straight tube portion at the most upstream position is virtually divided into four areas ARA-1 to ARA-4 with two straight lines X1, X2 as the boundaries, the two straight lines X1, X2 being obtained by tilting a minor axis X as the axis of the short diameter of the oval, which is the opening cross-sectional shape of the straight tube portion at the most upstream position, by ±45° with the center P of the oval as the center.

A flow rate mt of the primary combustion air injected from the primary combustion air nozzles 22A, 22B located in the areas ARA-1, ARA-2 containing the minor axis X of the oval is set to be lower than the flow rate of the primary combustion air injected from the primary combustion air nozzles 22C, 22D located in the areas ARA-3, ARA-4, respectively, not containing the minor axis X of the oval (also referred the area containing the major axis Y). More specifically, a flow rate ratio (mt/mx) is set to less than 0.5, the flow rate ratio which is a ratio of the flow rate mt of the primary combustion air injected from the primary combustion air nozzles 22A, 22B located in the areas ARA-1, ARA-2 containing the minor axis X of the oval to the total air quantity mx of the primary combustion air injected from all of the primary combustion air nozzles 22. Preferably, the flow rate ratio (mt/mx) is set to 0.45 or less.

In this example, the flow rate ratio (mt/mx) is set to be equal to or larger than $La^2/(La^2+Lb^2)$. Preferably, the flow rate ratio (mt/mx) is set to be equal to or larger than La/(La+Lb).

More specifically, in this example, the flow rate distribution of the primary combustion air is designed to satisfy Equation (1):

$$La^2/(La^2+Lb^2) \leq (mt/mx) < 0.5 \quad (1).$$

In this example, as a configuration of reducing the flow rate mt of the primary combustion air from the primary combustion air nozzles 22A, 22B on the minor axis X side to be lower than the flow rate of the primary combustion air from the primary combustion air nozzles 22C, 22D on the major axis Y side, the total opening cross-sectional area of the primary combustion air nozzles 22 located in the areas ARA-1, ARA-2 containing the minor axis X of the oval is set to be smaller than the total opening cross-sectional area of the primary combustion air nozzles 22 located in the areas ARA-3, ARA-4 containing the major axis Y of the oval, and a ratio between the two total opening areas is adjusted such that a flow rate ratio satisfying Equation (1) is achieved.

As a configuration of setting the flow rate mt of the primary combustion air injected from the primary combustion air nozzles 22A, 22B on the minor axis X side to be lower than the flow rate of the primary combustion air from the primary combustion air nozzles 22C, 22D on the major axis Y side, there is also a method of adjusting the blending ratio by independently providing a supply path for each combustion air on the minor axis X side and the major axis Y side and individually supplying the combustion air or providing a flow rate control valve in the middle of the flow path. However, the configuration of adjusting the opening area ratio between the two nozzles is simple.

The flow rates of the primary combustion air from the areas ARA-1 to ARA-4 (upper and lower areas, left and right areas) that are point-symmetric with respect to the center p of the oval are preferably equal to each other. More specifically, the flow rate of the primary combustion air supplied from the upper area ARA-4 is set to be equal to the flow rate of the primary combustion air supplied from the lower area ARA-3. The flow rate of the primary combustion air supplied from the area ARA-1 on the left side and the flow rate of the primary combustion air supplied from the area ARA-2 on the right side are set to be equal to each other.

Nozzle Arrangement

FIG. 5 illustrates an example where one primary combustion air nozzle 22 is arranged in each of the four areas ARA-1 to ARA-4 but this disclosure is not limited thereto. For example, two or more primary combustion air nozzles 22 may be arranged in each of the areas ARA-1 to ARA-4.

Further, FIG. 5 illustrates an example where each primary combustion air nozzle 22 is arranged on the major axis Y or the minor axis X of the oval shape, but this disclosure is not limited thereto. For example, each primary combustion air nozzle 22 does not have to be arranged to overlap on the major axis Y or the minor axis X.

FIG. 5 illustrates, as the opening shape of the hole constituting the primary combustion air nozzles 22, a fan shape in which the distance in the circumferential direction increases as away from the center p of the oval in the outer diameter direction but this disclosure is not limited thereto. For example, the opening shape of the hole constituting the primary combustion air nozzle 22 is not particularly limited and may be a shape other than the fan shape.

The distance from the center p of the oval to each primary combustion air nozzle 22 may be set to be different between the primary combustion air nozzles 22A, 22B on the minor axis X side and the primary combustion air nozzles 22C, 22D on the major axis Y side.

Operation and Others

In the radiant tube 100 of this example, the combustion air or the fuel gas is injected (discharged) and supplied from each nozzle of the radiant tube burner 2 in the direction parallel to the axis of the straight tube portion 1A at the most upstream position constituting the tube 1.

This example employs a two-stage combustion method in which the fuel gas injected from the fuel gas nozzles 23 is mixed with the primary combustion air injected from the primary combustion air nozzles 22 and incompletely burned, and then the incompletely burned combustion gas is completely burned by the secondary combustion air discharged from the secondary combustion air nozzle 21 so that NOx is reduced. The generated combustion gas flows along the tube 1.

In this example, with respect to the total amount of the primary combustion air to be supplied, the flow rate mt of the primary combustion air from the primary combustion air nozzles 22A, 22B on the minor axis X side which is the axis of the short diameter is set to be relatively lower than the flow rate of the primary combustion air from the primary combustion air nozzles 22C, 22D on the major axis side which is the axis of the long diameter orthogonal to the short diameter so that the generation of NOx due to combustion is further suppressed.

The opening cross-sectional shape of the tube 1 was set to an oval (Short diameter La: 188 mm, Long diameter Lb: 236 mm), and then the relationship between the flow rate ratio (mt/mx) and NOx was analyzed by an NOx generation prediction simulation using the finite volume method. The results are illustrated in FIG. 6.

Figure 6:
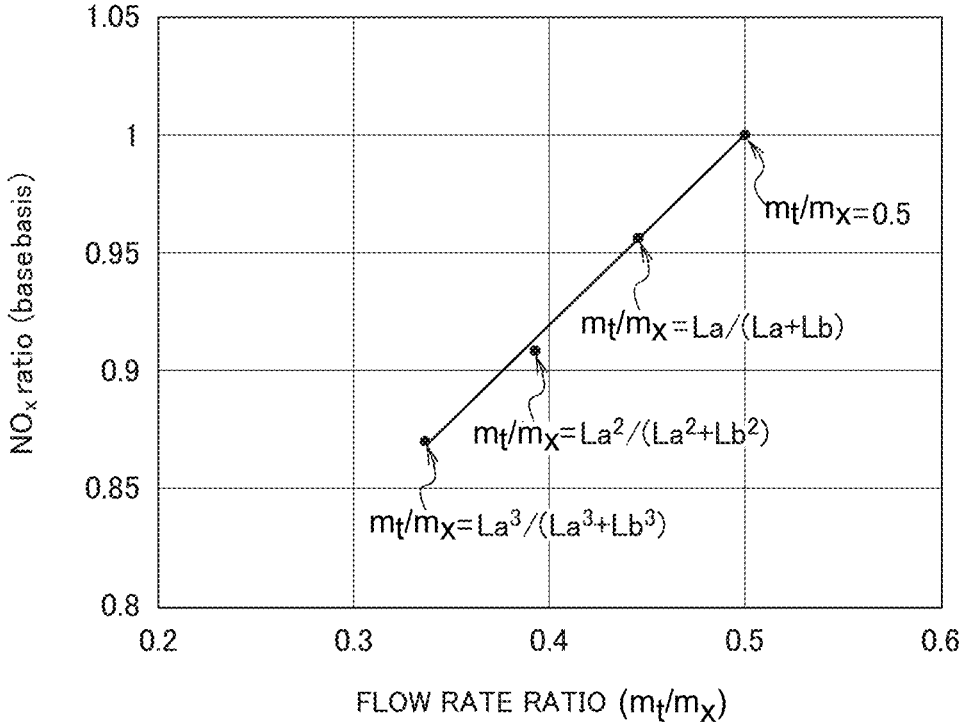
FIG. 6 is a view illustrating the relationship between the flow rate ratio and the NOx ratio.

In FIG. 6, the horizontal axis represents the flow rate ratio (mt/mx) and the vertical axis represents the NOx ratio when normalized by setting the amount of NOx generated when mt/mx=0.5 as 1 (NOx generation amount).

As is understood from FIG. 6, we found that NOx decreased when the flow rate mt of the primary combustion air from the primary combustion air nozzles 22A, 22B on the minor axis X side is set to be relatively lower than the flow rate of the primary combustion air from the primary combustion air nozzles 22C, 22D on the major axis Y side.

This is presumed to be because the discharged amounts of the primary combustion air from the adjacent areas ARA-1 to ARA-4 are different, and thus a ratio of the air to be blown is adjusted for each of the areas ARA-1 to ARA-4 and an appropriate N2 concentration distribution is achieved, which leads to the suppression of the generation of NOx.

On the other hand, when the tube shape of the radiant tube 100 is set to an oval shape, the surface on the short diameter La side where the area is relatively large is preferably made to face an object to be heated in consideration of the radiation area with the object to be heated. The reduction in the amount of the air injected to the short diameter La side as in this example increases the occurrence of non-combustion in the areas ARA-1, ARA-2 on the short diameter La side, and thus poses a risk that the surface temperature on the short diameter La side of the radiant tube 100 decreases so that the heat transfer efficiency decreases.

Figure 7:
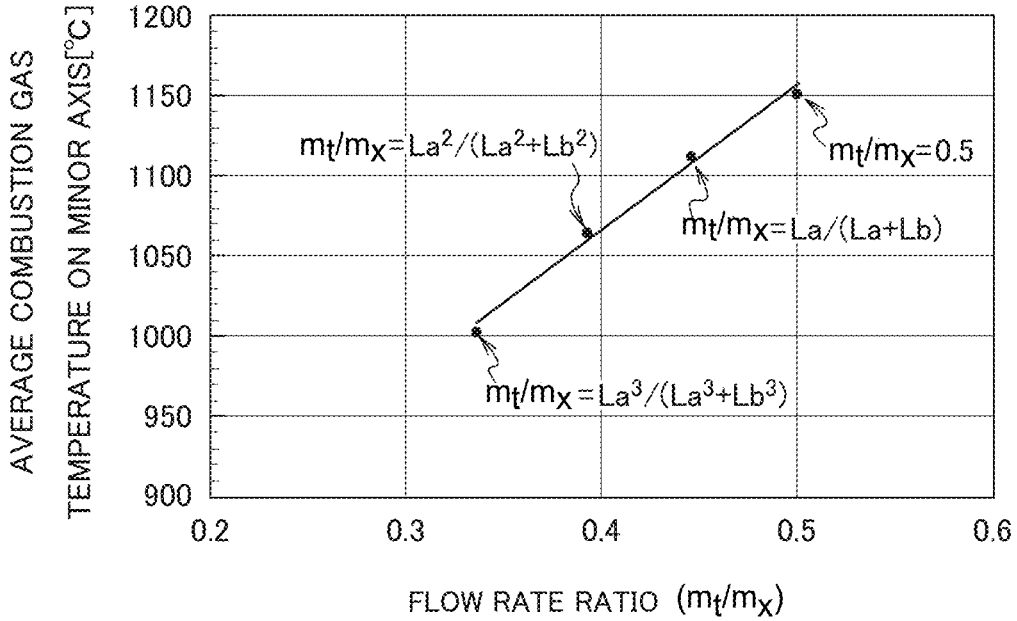
FIG. 7 is a view illustrating the relationship between the flow rate ratio and the combustion gas temperature on the minor axis side.

Thus, when the relationship between the flow rate ratio and the average combustion gas temperature on the minor axis X was determined, the results illustrated in FIG. 7 were obtained.

FIG. 7 illustrates the determination of the average temperature on the minor axis X in the oval of a cross section perpendicular to the flow direction at a point 2000 mm away in the injection direction from the primary combustion air nozzles 22 and the fuel gas nozzles 23, i.e., ejection surface.

As is understood from FIG. 7, when the flow rate ratio (mt/mx) is made smaller than 0.5, the average gas temperature on the minor axis X side further decreases.

Based on these results, the flow rate ratio (mt/mx) is preferably set to be equal to or larger than $La^2/(La^2+Lb^2)$ and the flow rate ratio (mt/mx) is more preferably set to be equal to or larger than La/(La+Lb) to prevent the reduction in heat transfer efficiency while exhibiting a low NOx effect.

As described above, this example can provide the radiant tube burner 2 and the radiant tube 100 capable of reducing NOx with a simple configuration without adversely affecting the maintainability and causing a reduction in the low NOx effect due to poisoning or the like.

The entire contents of JP 2020-020549 A (filed on Feb. 10, 2020) for which this application claims priority form a part of this disclosure by reference. While our radiant tube burners have been described with reference to a limited number of examples, the scope of this disclosure is not limited thereto, and modifications of each example based on the disclosure above are within the purview of those skilled in the art.

The invention claimed is:

1. A radiant tube burner adapted to be inserted and installed in a tube having an oval-shaped opening cross section, the opening cross section of the tube is virtually divided into four areas with two straight lines as boundaries, the two straight lines being obtained by tilting a minor axis of the oval, which is a shape of the opening cross section, by ±45° with a center of the oval as a center thereby defining two quadrants containing the minor axis of the oval and two quadrants not containing the minor axis of the oval, the radiant tube burner comprising:

a gas injection unit having a secondary combustion air nozzle injecting secondary combustion air arranged in a center portion;

a plurality of primary combustion air nozzles injecting primary combustion air;

a plurality of fuel gas nozzles injecting fuel gas arranged to surround the secondary combustion air nozzle, wherein a flow rate of the primary combustion air injected from the primary combustion air nozzles located in the areas containing the minor axis of the oval of the virtually divided four areas is lower than a flow rate of the primary combustion air injected from the primary combustion air nozzles located in the areas not containing the minor axis of the oval the four areas.

2. The radiant tube burner according to claim 1, wherein, when a short diameter of the oval is defined as La and a long diameter orthogonal to the short diameter is defined as Lb, a flow rate ratio (mt/mx) is set to be equal to or larger than $La^2/(La^2+Lb^2)$, the flow rate ratio (mt/mx) being a ratio of a flow rate mt of the primary combustion air injected from the primary combustion air nozzles located in the areas containing the minor axis to a total air quantity mx of the primary combustion air injected from all of the primary combustion air nozzles.

3. The radiant tube burner according to claim 1, wherein the flow rate of the primary combustion air injected from the primary combustion air nozzles is adjusted by reducing a total opening cross-sectional area of the primary combustion air nozzles located in the areas containing the minor axis to be smaller than a total opening cross-sectional area of the primary combustion air nozzles located in the areas not containing the minor axis of the oval.

4. The radiant tube burner according to claim 2, wherein the flow rate of the primary combustion air injected from the primary combustion air nozzles is adjusted by reducing a total opening cross-sectional area of the primary combustion air nozzles located in the areas containing the minor axis to be smaller than a total opening cross-sectional area of the primary combustion air nozzles located in the areas not containing the minor axis of the oval.

5. A radiant tube assembly comprising:

a tube having an oval-shaped opening cross section, the opening cross section of the tube is virtually divided into four areas with two straight lines as boundaries, the two straight lines being obtained by tilting a minor axis of the oval, which is a shape of the opening cross section, by ±45° with a center of the oval as a center thereby defining two quadrants containing the minor axis of the oval and two quadrants not containing the minor axis of the oval; and the radiant tube burner according to claim 1.

6. A radiant tube assembly comprising:

a tube having an oval-shaped opening cross section, the opening cross section of the tube is virtually divided into four areas with two straight lines as boundaries, the two straight lines being obtained by tilting a minor axis of the oval, which is a shape of the opening cross section, by ±45° with a center of the oval as a center thereby defining two quadrants containing the minor axis of the oval and two quadrants not containing the minor axis of the oval; and the radiant tube burner according to claim 2, wherein an opening cross section of the tube is formed in an oval shape.

7. A radiant tube assembly comprising:

a tube having an oval-shaped opening cross section, the opening cross section of the tube is virtually divided into four areas with two straight lines as boundaries, the two straight lines being obtained by tilting a minor axis of the oval, which is a shape of the opening cross section, by ±45° with a center of the oval as a center thereby defining two quadrants containing the minor axis of the oval and two quadrants not containing the minor axis of the oval; and the radiant tube burner according to claim 3, wherein an opening cross section of the tube is formed in an oval shape.

8. A radiant tube assembly comprising:

a tube having an oval-shaped opening cross section, the opening cross section of the tube is virtually divided into four areas with two straight lines as boundaries, the two straight lines being obtained by tilting a minor axis of the oval, which is a shape of the opening cross section, by ±45° with a center of the oval as a center thereby defining two quadrants containing the minor axis of the oval and two quadrants not containing the minor axis of the oval; and the radiant tube burner according to claim 4, wherein an opening cross section of the tube is formed in an oval shape.

9. A method of designing a radiant tube burner adapted to be inserted and installed in a tube having an oval-shaped opening cross section and which has a gas injection unit having a secondary combustion air nozzle injecting secondary combustion air arranged in a center portion and a plurality of primary combustion air nozzles injecting primary combustion air and a plurality of fuel gas nozzles injecting fuel gas arranged to surround the secondary combustion air nozzle, the method comprising:

virtually dividing the opening cross section of the tube into four areas with two straight lines as boundaries, the two straight lines being obtained by tilting a minor axis of the oval, which is a shape of the opening cross section, by ±45° with a center of the oval as a center; and when a short diameter of the oval is defined as La and a long diameter orthogonal to the short combustion diameter is defined as Lb, setting an amount of the primary combustion air blown out from each of the primary combustion air nozzles such that a flow rate ratio (mt/mx) satisfies Equation (1), the flow rate ratio (mt/mx) being a ratio of a flow rate mt of the primary combustion air injected from the primary combustion air nozzles located in the areas containing the minor axis to a total air quantity mx of the primary combustion air injected from all of the primary combustion air nozzles, $$La^2/(La^2+Lb^2) \leq (mt/mx) < 0.5 \quad (1).$$

* * * * *